US006074400A

United States Patent [19]

Nuijs et al.

[11] Patent Number: 6,074,400

[45] Date of Patent: Jun. 13, 2000

[54] DEPILATION APPARATUS WITH TWISTING ACTION ONLY

[75] Inventors: Antonius M. Nuijs; Andreas J. Garenfeld, both of Eindhoven; Robert H. Munnig Schmidt, Groningen, all of Netherlands

[73] Assignee: U.S. Philips Corporation, New York, N.Y.

[21] Appl. No.: 09/211,923

[22] Filed: Dec. 15, 1998

[30] Foreign Application Priority Data

Dec. 16, 1997 [EP] European Pat. Off. ..... 97203950

[51] Int. Cl.[7] ..... A61B 17/50

[52] U.S. Cl. ..... 606/133

[58] Field of Search ..... 606/130, 131, 606/133

[56] References Cited

U.S. PATENT DOCUMENTS 5,312,419 5/1994 Garenfeld et al. ..... 606/133

FOREIGN PATENT DOCUMENTS

0549051A1 6/1993 European Pat. Off. ..... A45D 26/00

*Primary Examiner*—Michael Buiz
*Assistant Examiner*—Vy Q. Bui
*Attorney, Agent, or Firm*—Ernestine C. Bartlett

[57] ABSTRACT

The invention relates to a depilation apparatus, comprising a housing which accommodates a pinching member for consecutively pinching hairs growing from human skin and twisting the pinched hairs about their longitudinal axes.

According to the invention, the pinching member holds the pinched hairs in a substantially constant position relative to the housing while twisting the hairs. In this manner, the pinching member does not pull at the hairs and, therefore, does not cause any pain while twisting the hairs. The hairs are twisted by the pinching member until the adhesion between the hairs and the skin tissue is broken or until the hairs are broken beneath the skin surface. After having been twisted in this manner, the hairs can be removed from the skin substantially without pain.

The pinching member of a preferred embodiment of the depilation device comprises at least two co-operating pinching elements which are periodically movable from a hair trapping position to a pinching position and from the pinching position back to the hair trapping position, the pinching elements sliding along one another in the pinching position at speeds which are equal but oppositely directed relative to the housing.

6 Claims, 3 Drawing Sheets

DEPILATION APPARATUS WITH TWISTING ACTION ONLY

BACKGROUND OF THE INVENTION

The invention relates to a depilation apparatus provided with a housing which accommodates a pinching member for consecutively pinching hairs growing from human skin and twisting these hairs about their longitudinal axes.

A depilation apparatus of the kind set forth is known from EP-A-0 549 051 , which corresponds substantially to U.S. Pat. No. 5,312,419, assigned to the same assignee as herein, U.S. Philips Corporation. The pinching member of the known depilation apparatus consists of an epilation member whereby hairs growing from the skin are consecutively clamped in, twisted about their longitudinal axes and ultimately pulled from the skin. Because in the known depilation apparatus the hairs are twisted about their longitudinal axes before being pulled from the skin by the epilation member, the adhesion between the hair roots and the hair follicles from which the hairs grow and the adhesion between the hairs and the hair vesicles are partly broken before the hairs are pulled from the skin. A considerable reduction of the pulling force required is thus achieved and the pulling along of the skin during the pulling out of the hairs, being an unpleasant experience, is partly avoided so that the pain experienced during the pulling out of the hairs is considerably reduced.

It is a drawback of the known depilation apparatus that the adhesion between the hair roots and the hair follicles and the adhesion between the hairs and the hair vesicles are not completely broken during the twisting of the hairs, so that the skin is pulled along to some extent during the pulling out of the hairs and the user experiences some pain during the pulling out of the hairs.

SUMMARY OF THE INVENTION

It is an object of the invention to provide a depilation apparatus in which the pain experienced during the removal of the hairs from the skin is reduced even further.

The depilation apparatus according to the invention is for this purpose characterized in that during operation the pinching member keeps the pinched hairs in a substantially constant position relative to the housing during twisting.

Because the pinching member keeps the pinched hairs in a substantially constant position relative to the housing during twisting, the pinched hairs are substantially exclusively twisted by the pinching member, i.e. the pinching member exerts hardly any pulling force on the pinched hairs. As a result, that the pinched hairs are twisted by the pinching member until the adhesion between the hair roots and the hair follicles and the adhesion between the hairs and the hair vesicles are substantially completely broken. It has been found that for a considerable part of the hairs twisting does not break said adhesions, but causes a fracture in the hairs between the hair roots and the skin surface. The hairs thus twisted are removed from the skin substantially without pain. This is realized in that the user moves the depilation apparatus across the skin surface, the twisted hairs then being taken along by the pinching member. However, the depilation apparatus may also be provided with a separate component for removing the twisted hairs from the skin, for example a simple brush arranged adjacent the pinching member.

A special embodiment of a depilation apparatus according to the invention is characterized in that the pinching member comprises at least two pinching elements, each of which is provided with a pinching face, said pinching elements being mutually displaceable from a trapping position, in which the pinching faces of the two pinching elements are situated at a distance from one another, to a pinching position in which the pinching elements mutually exert a pinching force via the pinching faces, the pinching faces in the pinching position being slidable along one another, relative to the housing, at equal but oppositely directed speeds. Because the pinching faces of the pinching elements can slide along one another in the pinching position, the hairs pinched between the pinching faces are twisted about their longitudinal axes. Because, moreover, the speeds at which the pinching faces can slide along one another in the pinching position, relative to the housing, are equally high but opposed, it is ensured, in a particularly simple and practical manner, that the hairs pinched between the pinching faces are also maintained in a substantially constant position relative to the housing.

A further embodiment of a depilation apparatus according to the invention is characterized in that each of the pinching elements includes a disc-shaped pinching plate which extends transversely of a hair trapping opening of the housing, the disc-shaped pinching plates in the pinching position being rotatable, relative to the housing, at equal but oppositely directed rotational speeds about an axis of rotation extending substantially parallel to the hair trapping opening. As a result of the use of the disc-shaped pinching plates which are rotatable about said axis of rotation at equally high but oppositely directed rotational speeds relative to the housing, it is achieved, in a simple and practical manner, that the pinching faces of the pinching elements in the pinching position are slidable, relative to the housing, along one another at equally high but oppositely directed speeds.

A further embodiment of a depilation apparatus according to the invention is characterized in that a first one of the disc-shaped pinching plates is connected to a first drive shaft which extends substantially parallel to the hair trapping opening, a second one of the disc-shaped pinching plates being connected to a second drive shaft which is arranged so as to be coaxial with the first drive shaft, at least one of the two drive shafts being slidable in the axial direction relative to the housing and the drive shafts being drivable at equal but oppositely directed rotational speeds. The disc-shaped pinching plates in this further embodiment can be mutually displaced from the trapping position to the pinching position by axial displacement of at least one of the two drive shafts.

A special embodiment of a depilation apparatus according to the invention is characterized in that a first one of the disc-shaped pinching plates is connected to a drive shaft which extends substantially parallel to the hair trapping opening and is slidable in the axial direction relative to the housing, whereas a second one of the disc-shaped pinching plates is rotatably journaled, relative to the housing, about an axis of rotation which is substantially coincident with a center line of said drive shaft, the second pinching plate being drivable, via a transmission, by means of an auxiliary drive shaft which extends parallel to the drive shaft. The disc-shaped pinching plates in this special embodiment arrive in the clamping position under the influence of an axial displacement of said drive shaft with the first pinching plate. The use of said auxiliary drive shaft, driving the second pinching plate via said transmission, results in a construction in which more than one pair of co-operating pinching plates can be arranged adjacent one another in a simple and practical manner in order to increase the hair trapping range of the depilation apparatus. The first pinching plate of each pair of co-operating pinching plates in such a construction is connected to a drive shaft which is common to all pinching plates and is slidable in the axial direction, whereas the second pinching plate of each pair of co-operating pinching plates is journaled so as to be slidable and rotatable about the common drive shaft and can be driven to rotate, via a separate transmission such as, for example, a belt transmission, by the auxiliary drive shaft.

A further embodiment of a depilation apparatus according to the invention is characterized in that the second disc-shaped pinching plate is rotatably journaled relative to a sliding member which is slidable in the axial direction relative to the housing. Such a sliding member in this further embodiment renders the first disc-shaped pinching plate as well as the second disc-shaped pinching plate slidable in the axial direction, thus limiting a distance over which the first disc-shaped pinching plate and the second disc-shaped pinching plate should be slidable in the axial direction in order to achieve a desired hair trapping range.

BRIEF DESCRIPTION OF THE DRAWINGS

The invention will be described in detail hereinafter with reference to the drawing wherein.

DESCRIPTION OF THE PREFERRED EMBODIMENTS

Figure 1:
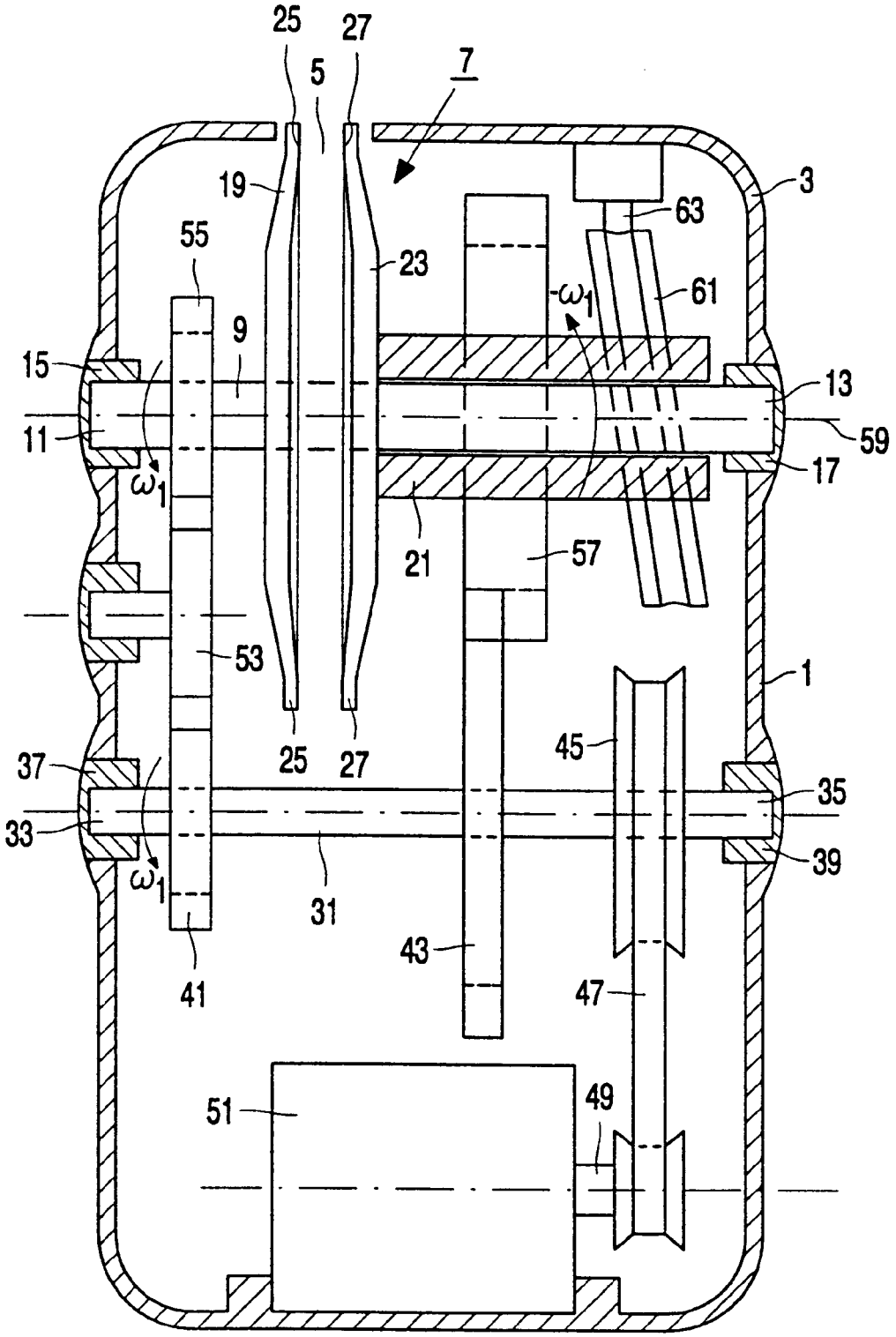
FIG. 1 shows a first embodiment of a depilation apparatus according to the invention.

The first embodiment of a depilation apparatus according to the invention shown in FIG. 1 is provided with a housing 1 having a depilation head 3 in which a hair trapping opening 5 is provided. The depilation head 3 accommodates a pinching member 7 whereby the skin to be treated can be exposed through the hair trapping opening 5.

As is shown in FIG. 1, the pinching member 7 is provided with a first metal drive shaft 9 which is arranged substantially parallel to the hair trapping opening 5 and is rotatably journaled, by way of journals 11 and 13, in bearing bushes 15 and 17 provided in the depilation head 3. A first, rigid disc-shaped metal pinching plate 19 is connected to the first drive shaft 9 so as to extend transversely of the first drive shaft 9 and the hair trapping opening 5. The pinching member 7 also includes a second metal drive shaft 21 which is formed as a sleeve and is arranged so as to be coaxial with the first drive shaft 9. The second drive shaft 21 is journaled so as to be rotatable about the first drive shaft 9 and is also guided so as to be slidable in the axial direction relative to the first drive shaft 9 and the housing 1. A second rigid disc-shaped metal pinching plate 23 is attached to the second drive shaft 21; this second pinching plate 23 also extends transversely of the drive shafts 9, 21 and the hair trapping opening 5. Each of the two disc-shaped pinching plates 19, 23 constitutes a respective pinching element of the pinching member 7; they are provided with facing, co-operating annular pinching surfaces 25, 27 which are situated near an outer edge of the pinching plates 19, 23. As will be described in detail hereinafter, the pinching plates 19, 23 are mutually displaceable, by an axial displacement of the second drive shaft 21 with the second pinching plate 23, from a trapping position as shown in FIG. 1, in which the pinching surfaces 25, 27 are situated at a distance from one another and hairs growing from the skin can enter, via the hair trapping opening 5, the space between the pinching faces 25, 27, to a pinching position in which the pinching plates 19, 23 mutually exert, via the pinching faces 25, 27, a pinching force and said hairs are pinched between the pinching faces 25, 27.

FIG. 1 also shows that the housing 1 also accommodates an auxiliary drive shaft 31 which extends parallel to the drive shafts 9, 21 and is rotatably journaled, by way of journals 33 and 35, in bearing bushes 37 and 39 provided in the housing 1. A first gear wheel 41, a second gear wheel 43 and a drive wheel 45 are attached to the auxiliary drive shaft 31. The drive wheel 45 is coupled, via a drive belt 47, to a driving shaft 49 of an electric motor 51 arranged in the housing 1 so that the auxiliary drive shaft 31 can be driven by the motor 51. The first gear wheel 41 engages a third gear wheel 53 which is identical to the first gear wheel 41 and is rotatably journaled relative to the housing 1. The third gear wheel 53 engages a fourth gear wheel 55 which is also identical to the first gear wheel 41 and is attached to the first drive shaft 9. The first drive shaft 9 with the first disc-shaped pinching plate 11 can thus be driven, via the gear wheels 41, 53 and 55, at a rotational speed $\omega_1$ which is equal to and directed in the same direction as a rotational speed $\omega_1$ of the auxiliary drive shaft 31. The second gear wheel 43 engages a fifth gear wheel 57 which has the same diameter as the second gear wheel 43 and is connected to the second drive shaft 21. The second drive shaft 21 with the second disc-shaped pinching plate 23 can thus be driven, via the gear wheels 43 and 57, at a rotational speed $-\omega_1$ which is equal to but is oppositely directed to the rotational speed $\omega_1$ of the auxiliary drive shaft 31. As a result of this arrangement that the disc-shaped pinching plates 19, 23 are rotatable, relative to the housing 1, at equally high, mutually opposed rotational speeds $\omega_1$, $-\omega_1$ about an axis of rotation 59 which extends substantially parallel to the hair trapping opening 5 and coincides with the center lines of the drive shafts 9, 21.

FIG. 1 also shows that to the second drive shaft 21 there is connected a guide wheel 61 which is arranged obliquely relative to the second drive shaft 21. The guide wheel 61 engages a guide pin 63 provided in the depilation head 3. Because of the presence of the guide wheel 61 and the guide pin 63, during operation the second drive shaft 21 with the second disc-shaped pinching plate 23 performs, in addition to a rotary motion, an oscillatory sliding motion in the axial direction so that the disc-shaped pinching plates 19, 23 are periodically displaced with respect to each other in the axial direction from the trapping position shown in FIG. 1 to the previously mentioned pinching position and back from the pinching position to the trapping position again. It is to be noted that the width of the fifth gear wheel 57 in the axial direction is such that it remains in engagement with the second gear wheel 43 during the axial displacements of the second drive shaft 21.

Figure 2:
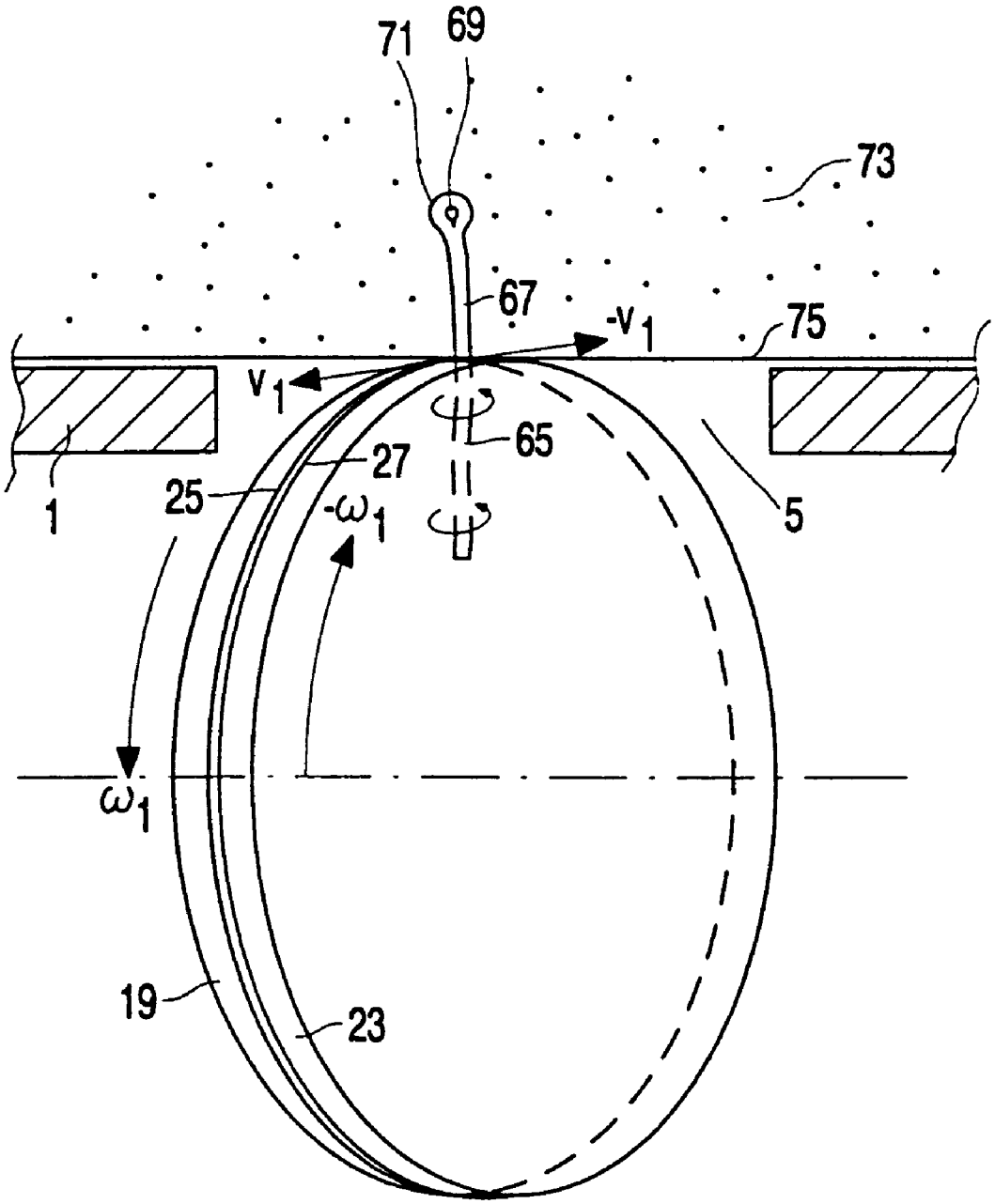
FIG. 2 shows diagrammatically the twisting of a hair between two pinching plates of the depilation apparatus shown in FIG. 1.

As described before, the hairs entering the space between the pinching plates 19, 23, via the hair trapping opening 5, in the trapping position of the pinching plates 19, 23, are pinched between the pinching faces 25, 27 in the subsequent pinching position of the pinching plates 19, 23. As is diagrammatically shown in FIG. 2, in the pinching position of the pinching plates 19, 23 the pinching faces 25, 27 are slid along one another, relative to the housing 1, at equally high but oppositely directed speeds $v_1$ and $-v_1$ due to the opposed rotary motions of the pinching plates 19, 23 near the hair trapping opening 5. Because the speeds at which the pinching faces 25, 27 slide along one another in the pinching position are oppositely directed, the pinched hairs are twisted about their longitudinal axes. FIG. 2 shows a single hair 65 for the purpose of illustration. Because said speeds, moreover, are equally high relative to the housing 1, it is achieved that the hairs 65 pinched between the pinching faces 25, 27 are retained in a substantially constant position relative to the housing 1 during twisting. Because the pinching member 7 thus keeps the pinched hairs 65 in a substantially constant position relative to the housing 1 during twisting, the pinched hairs 65 are practically only twisted by the pinching member 7, without the pinching member 7 pulling the pinched hairs 65 or only hardly so. Because during twisting the pinched hairs 65 are not at the same time pulled from the skin by the pinching member 7, the pinched hairs 65 are twisted by the pinching member 7 at least until the adhesion between the hairs 65 and the hair vesicles 67 and the adhesion between the hair roots 69 and the hair follicles 71 have been broken substantially completely. The hairs 65 thus twisted loose can subsequently be removed from the skin 73 without significant resistance and hence in a practically painless manner. This is realized, for example in that during the displacement of the hair depilation apparatus across the skin 73 the hairs 65 pinched between the pinching plates 19, 23 are displaced along by the pinching member 7 and are subsequently released when the pinching plates 19, 23 are displaced to the trapping position again. However, the depilation apparatus according to the invention may also be provided with separate means for removing the hairs 65 twisted loose from the skin 73, such as, for example a brush (not shown) which is arranged adjacent the hair trapping opening 5 and brushes the loose hairs 65 off the skin 73 during the displacement of the depilation apparatus across the skin. It is to be noted that tests have shown that for a substantial part of the hairs 65 the adhesion between the hair follicles 71 and the hair roots 69 and the adhesion between the hairs 65 and the hair vesicles 67 are not broken; instead, these hairs 65 are broken between the skin surface 75 and the hair root 69 and the adhesion between the hair vesicles 67 and the broken off parts of these hairs 65 is broken. The hair parts thus broken off can also be removed from the skin 73 without significant resistance and hence substantially without pain. The depilation apparatus according to the invention thus offers a smoothness which is comparable to a smoothness achieved by means of known and conventional epilation apparatus. Because a substantial part of the hairs is fractured during twisting, however, the smoothness achieved in most cases lasts for a period of time which is slightly shorter than in known and conventional epilation apparatus. This drawback, however, is more than compensated by the described advantage that the depilation apparatus according to the invention operates practically without inflicting pain.

Figure 3:
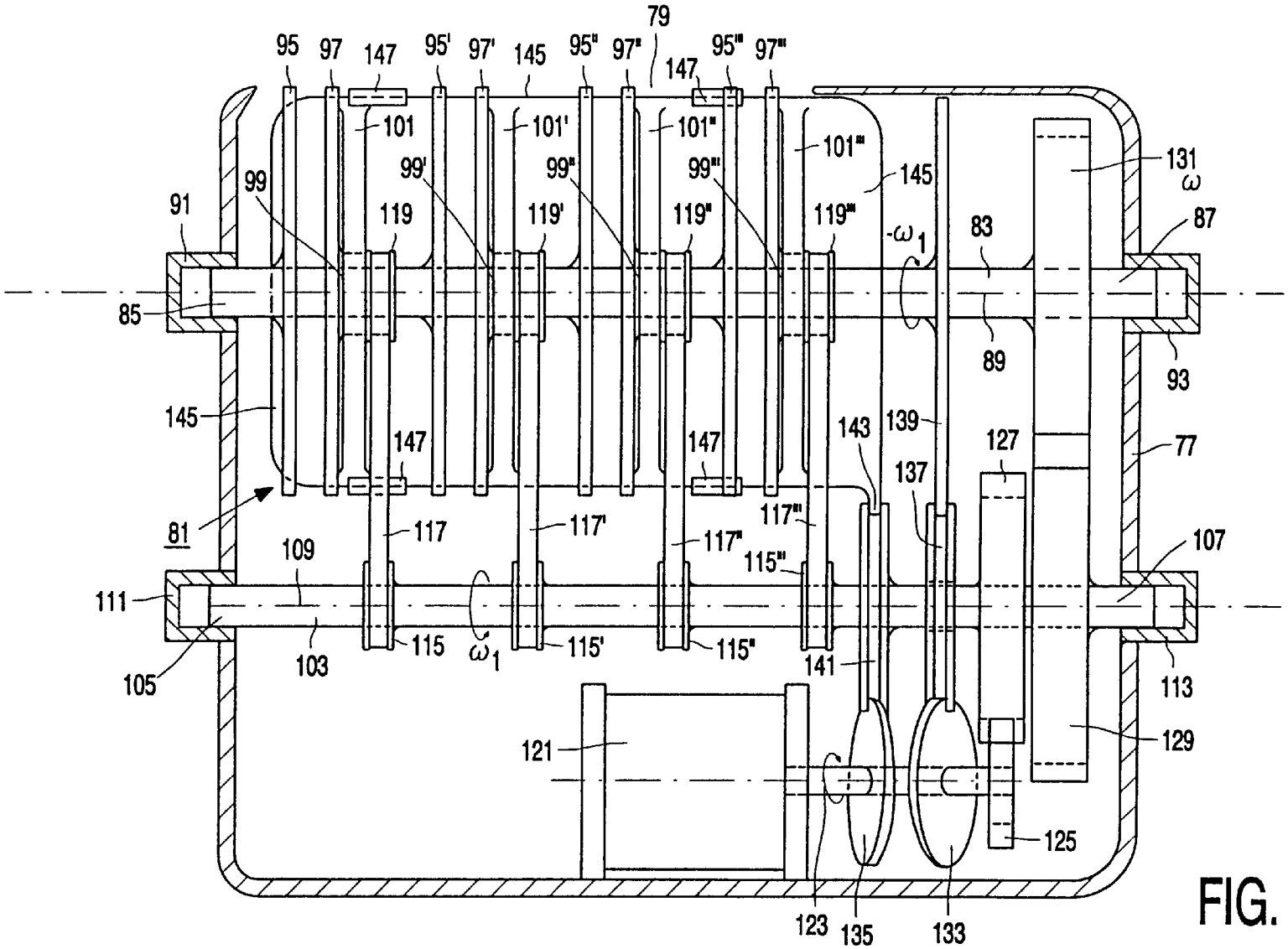
FIG. 3 shows a second embodiment of a depilation apparatus according to the invention.

The second embodiment of a depilation apparatus according to the invention as shown in FIG. 3 is provided with a housing 77 in which a hair trapping opening 79 is provided. The housing 77 accommodates a pinching member 81 whereto the skin to be treated can be exposed via the hair trapping opening 79.

FIG. 3 shows that the pinching member 81 is provided with a metal drive shaft 83 which is arranged substantially parallel to the hair trapping opening 79 and is journaled, by way of journals 85 and 87, so as to be rotatable about an axis of rotation 89, extending substantially parallel to the hair trapping opening 79, in bearing bushes 91 and 93 provided in the housing 77. Four rigid, disc-shaped metal pinching plates 95, 95', 95" and 95'" are attached to the drive shaft 83 so as to extend transversely of the drive shaft 83 and of the hair trapping opening 79. The pinching member 81 also comprises four further rigid, disc-shaped metal pinching plates 97, 97', 97" and 97'" which also extend transversely of the drive shaft 83 and the hair trapping opening 79. The pinching plates 95 and 97, the pinching plates 95' and 97', the pinching plates 95" and 97" and the pinching plates 95'" and 97'" constitute four pairs of co-operating pinching plates of the pinching member 81. It is to be noted that the pinching member 81 according to the invention may also be provided with a different number of pairs of co-operating pinching plates. Each of the further pinching plates 97, 97', 97" and 97'" is attached to a respective bearing bush 99, 99', 99" and 99'" which is arranged around the drive shaft 83 and is rotatably journaled in a plate-shaped bearing support 101, 101', 101", 101'" which extends transversely of the drive shaft 83. The further pinching plates 97, 97', 97" and 97'" are thus also rotatable about said axis of rotation 89.

FIG. 3 also shows that the pinching member 81 includes an auxiliary drive shaft 103 which extends parallel to the drive shaft 83 and is journaled, via journals 105 and 107, so as to be rotatable about an axis of rotation 109, extending substantially parallel to the hair trapping opening 79, in bearing bushes 111 and 113 provided in the housing 77. Four drive wheels 115, 115', 115" and 115'" are connected to the auxiliary drive shaft 103, each of said drive wheels being coupled, via a respective drive belt 117, 117, 117", 117'", to a further drive wheel 119 of the bearing bush 99, a further drive wheel 119' of the bearing bush 99', a further drive wheel 119" of the bearing bush 99" and a further drive wheel 119'" of the bearing bush 99'", respectively. The housing 77 also accommodates an electric motor 121 provided with a driving shaft 123 which extends parallel to the drive shaft 83 and the auxiliary drive shaft 103. Attached to the driving shaft 123 of the motor 121 is a first gear wheel 125 which engages a second gear wheel 127 attached to the auxiliary drive shaft 103. The motor 121 can drive the auxiliary drive shaft 103 at a rotational speed $\omega_1$, via the gear wheels 125 and 127. Also attached to the auxiliary drive shaft 103 is a third gear wheel 129 which engages a fourth gear wheel 131 which is attached to the drive shaft 83. The gear wheels 129 and 131 are identical, so that the drive shaft 83 can be driven by the motor 121, via the gear wheels 125, 127, 129 and 131, at a rotational speed $-\omega_1$ which is equal to but oppositely directed to the rotational speed $\omega_1$ of the auxiliary drive shaft 103. Because the drive wheels 115, 115', 115" and 115'" provided on the auxiliary drive shaft 103 and the further drive wheels 119, 119', 119" and 119'", attached to the further pinching plates 97, 97', 97" and 97'", are also identical, the pinching plates 95, 95', 95", 95'" and the further pinching plates 97, 97', 97", 97'" can be driven at equal but oppositely directed rotational speeds.

FIG. 3 also shows that a first guide disc 133 and an identical second guide disc 135 are mounted on the driving shaft 123 of the motor 121, said guide discs being obliquely arranged relative to the driving shaft 123 in a mutually opposed fashion. The first guide disc 133 engages a first guide wheel 137 which is arranged around the auxiliary drive shaft 103 and is journaled so as to be rotatable as well as slidable in the axial direction relative to the auxiliary drive shaft 103. The first guide wheel 137 engages a guide plate 139 which is connected to the drive shaft 83 and extends perpendicularly to the drive shaft 83. The second guide disc 135 engages a second guide wheel 141 which is connected to the auxiliary drive shaft 103. The second guide wheel 141 also engages a guide pin 143 which is attached to a sliding member 145 which is journaled, by way of guides 147, so as to be slidable in the axial direction relative to the housing 77. The afore-mentioned plate-shaped bearing supports 101, 101', 101" and 101'" of the further pinching plates 97, 97', 97" and 97'" are attached to the sliding member 145. Because of the presence of the guide discs 133 and 135, the guide wheels 137 and 141, the guide plate 139, the guide pin 143 and the sliding member 145, during operation the drive shaft 83 with the pinching plates 95, 95', 95" and 95'" and the auxiliary drive shaft 103 with the sliding member 145 and the further pinching plates 97, 97', 97" and 97'" coupled thereto are slid in the axial direction, relative to the housing 77, in an oscillating fashion and at equal but oppositely directed sliding speeds, so that the pinching plates 95, 95', 95", 95'" and the further pinching plates 97, 97', 97", 97'" are periodically displaced with respect to each other in the axial direction from a hair trapping position as shown in FIG. 3 to a pinching position and from the pinching position back to the hair trapping position again. It is to be noted that the width of the second gear wheel 127 in the axial direction is such that the first gear wheel 125 remains in engagement with the second gear wheel 127 during the axial displacements of the auxiliary drive shaft 103, and that the width of the third gear wheel 129 and the width of the fourth gear wheel 131 in the axial direction are such that the third gear wheel 129 and the fourth gear wheel 131 also remain in engagement with one another during the axial displacements of the drive shaft 83 and the auxiliary drive shaft 103.

Because the depilation apparatus according to the invention as shown in FIG. 3 includes four pairs of co-operating pinching plates, its hair trapping range is significantly greater than a hair trapping range of the depilation apparatus according to the invention as shown in FIG. 1. The described construction of the pinching member 81, including more than one pair of co-operating pinching plates, can be realized because of the use of the auxiliary drive shaft 103 which drives the further pinching plates 97, 97', 97", 97'" co-operating with the pinching plates 95, 95', 95", 95'". It is to be noted that the driving of the further pinching plates 97, 97', 97", 97'" by the auxiliary drive shaft 103 can also take place via a different type of transmission, for example via a system of gear wheels which are journaled relative to the sliding member 145 or via toothed drive belts. Because the drive shaft 83 with the pinching plates 95, 95', 95", 95'" and the sliding member 145 with the further pinching plates 97, 97', 97", 97'" are both slidable in the axial direction, a distance over which the drive shaft 83 with the pinching plates 95, 95', 95", 95'" should be slidable so as to achieve a desired hair trapping range is limited. It is to be noted that the invention also covers an alternative version of the embodiment of the depilation apparatus shown in FIG. 3; therein, the further pinching plates 97, 97', 97", 97'" occupy a fixed axial position relative to the housing 77. In such an alternative embodiment the sliding member 145, the guide wheel 141 and the guide disc 135 are absent, the auxiliary drive shaft 103 is not slidable in the axial direction, and the plate-shaped bearing supports 101, 101', 101", 101'" are attached to the housing 77 in a fixed position. In order to realize a hair trapping range which is comparable to that of the depilation apparatus shown in FIG. 3, however, the drive shaft 83 in such an alternative embodiment should be slidable in the axial direction over a distance which is larger than that over which the drive shaft 83 is slidable in the depilation apparatus shown in FIG. 3.

The pinching elements of the described embodiments of a depilation apparatus according to the invention are formed by disc-shaped pinching plates. However, it is to be noted that the invention is not restricted to depilation apparatus provided with disc-shaped pinching plates and that it also covers depilation apparatus provided with co-operating pinching elements of a different kind, for example disc-shaped pinching elements provided with windows or pinching elements as known from FR-A-667,265. Furthermore, the invention can also be used for depilation apparatus provided with tiltable disc-shaped pinching plates instead of axially displaceable disc-shaped pinching plates. However, a more complex construction of the drive for the pinching plates will generally have to be used in such depilation apparatus.

Finally it is to be noted that the invention covers not only depilation apparatus provided with a pinching member with co-operating pinching elements which are slidable along one another in the pinching position, but also covers depilation apparatus provided with a different type of pinching member. For example, a depilation apparatus according to the invention may also be provided with a tweezer-like pinching member; in that case the co-operating pinching elements are not slidable along one another in the pinching position but are rotatable, in the pinching position, about a common axis of rotation which extends substantially perpendicularly to the hair trapping opening of the depilation apparatus. When such a tweezer-like pinching member is used, the pinched hairs are twisted about their longitudinal axes under the influence of a rotary motion of the co-operating pinching elements about said common axis of rotation.

What is claimed is:

1. A depilation apparatus provided with a housing which accommodates a pinching member having pinching elements for consecutively pinching hairs growing from human skin and twisting these hairs about their longitudinal axes, wherein during operation the pinching elements in the pinching position are movable, relative to the housing, at equal but oppositely directed speeds whereby the pinching member keeps the pinched hairs in a substantially constant position relative to the housing during twisting.

2. A depilation apparatus as claimed in claim 1, wherein each of the pinching elements includes a disc-shaped pinching plate which extends transversely of a hair trapping opening of the housing, the disc-shaped pinching plates in the pinching position being rotatable, relative to the housing, at equal but oppositely directed rotational speeds about an axis of rotation extending substantially parallel to the hair trapping opening.

3. A depilation apparatus as claimed in claim 2, wherein a first one of the disc-shaped pinching plates is connected to a first drive shaft which extends substantially parallel to the hair trapping opening, a second one of the disc-shaped pinching plates being connected to a second drive shaft which is arranged so as to be coaxial with the first drive shaft, at least one of the two drive shafts being slidable in the axial direction relative to the housing and the drive shafts being drivable at equal but oppositely directed rotational speeds.

4. A depilation apparatus as claimed in claim 2, wherein a first one of the disc-shaped pinching plates is connected to a drive shaft which extends substantially parallel to the hair trapping opening and is slidable in the axial direction relative to the housing, whereas a second one of the disc-shaped pinching plates is rotatably journaled, relative to the housing, about an axis of rotation which is substantially coincident with a center line of said drive shaft, the second pinching plate being drivable, via a transmission, by means of an auxiliary drive shaft which extends parallel to the drive shaft.

5. A depilation apparatus as claimed in claim 4, wherein the second disc-shaped pinching plate is rotatably journaled relative to a sliding member which is slidable in the axial direction relative to the housing.

6. A depilation apparatus provided with a housing which accommodates a pinching member for consecutively pinching hairs growing from human skin and twisting these hairs about their longitudinal axes and for maintaining the pinched hairs during operation in a substantially constant position relative to the housing during twisting, wherein said pinching member comprises at least two pinching elements, each of which is provided with a pinching face, said pinching elements being mutually displaceable from a trapping position, in which the pinching faces of the two pinching elements are situated at a distance from one another, to a pinching position in which the pinching elements mutually exert a pinching force via the pinching faces, the pinching faces in the pinching position being slidable along one another, relative to the housing, at equal but oppositely directed speeds.

* * * * *